US006836929B2

(12) United States Patent
Kim

(10) Patent No.: US 6,836,929 B2
(45) Date of Patent: Jan. 4, 2005

(54) ACCESSARY TOOL MOUNTING DEVICE FOR VACUUM CLEANER

(75) Inventor: Yong-Bae Kim, Sachun Gyeongnam (KR)

(73) Assignee: LG Electronics Inc., Seoul (KR)

( * ) Notice: Subject to any disclaimer, the term of this patent is extended or adjusted under 35 U.S.C. 154(b) by 319 days.

(21) Appl. No.: 10/125,426

(22) Filed: Apr. 19, 2002

(65) Prior Publication Data

US 2003/0106181 A1 Jun. 12, 2003

(30) Foreign Application Priority Data

Dec. 11, 2001 (KR) ..... 2001-78322

(51) Int. Cl.[7] ..... A47L 9/00
(52) U.S. Cl. ..... 15/323
(58) Field of Search ..... 15/323, 327.1, 15/327.2, 327.6, 327.7

(56) References Cited

U.S. PATENT DOCUMENTS

2002/0083550 A1 * 7/2002 Yang ..... 15/323
2002/0178530 A1 * 12/2002 Iversen ..... 15/323

* cited by examiner

*Primary Examiner*—Terrence R. Till
(74) *Attorney, Agent, or Firm*—Fleshner & Kim, LLP

(57) ABSTRACT

An accessory tool mounting device is provided for a vacuum cleaner by means of which accessory tools can be detachably mounted on the vacuum cleaner. The vacuum cleaner includes a suction device, a plurality of wheels, and exhaust portions for filtering out foreign substances contained in air drawn in by the suction device and exhausted as filtered air. The accessory tool mounting device includes wheel fender portions that extend outwardly from a main body of the vacuum cleaner, exhaust-portion forming extensions that extend outwardly from the main body and are formed adjacent to the wheel fender portions, a fastening box member an upper end of which is open and which is formed between the wheel fender portion and the exhaust-portion forming extension, and an accessory mounting member comprising a U-shaped elastic fastening end which is insertable downwardly into the fastening box member.

4 Claims, 5 Drawing Sheets

FIG. 2
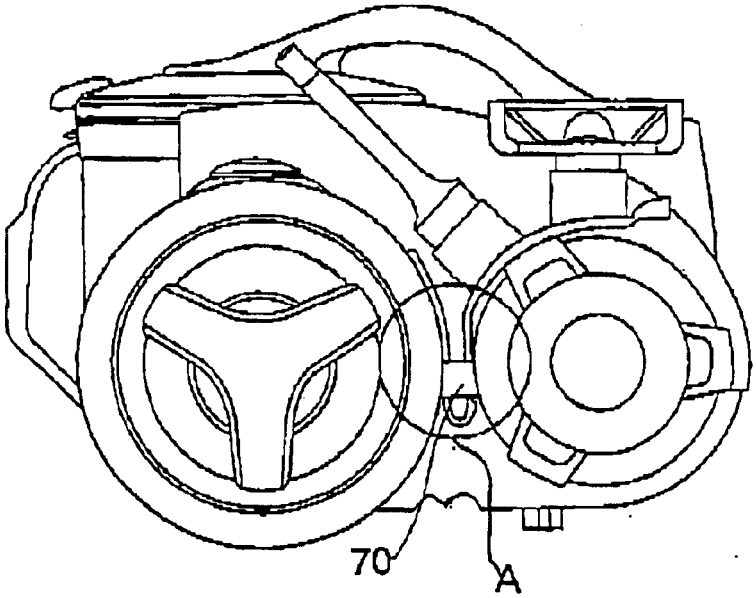
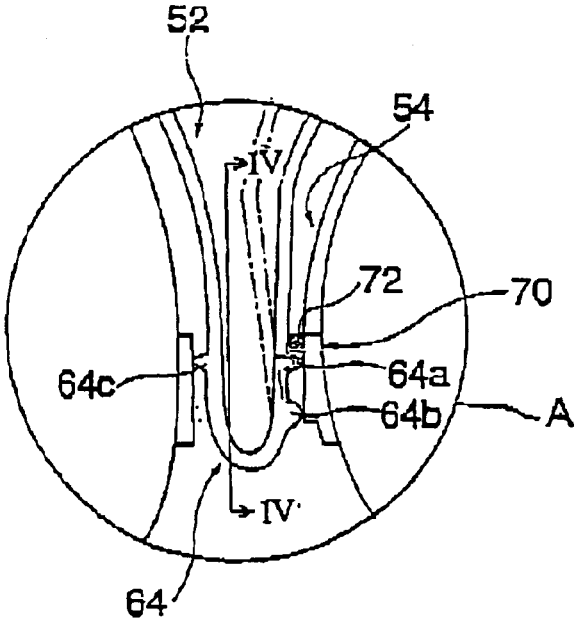
FIG. 2A

ACCESSARY TOOL MOUNTING DEVICE FOR VACUUM CLEANER

BACKGROUND OF THE INVENTION

1. Field of the Invention

The present invention relates to an accessory tool mounting device for a vacuum cleaner, and more particularly, to an accessory tool mounting device for a vacuum cleaner by which accessory tools can be detachably mounted on a main body of the vacuum cleaner in a more convenient manner and thus it is convenient to store and use the accessory tools.

2. Description of the Prior Art

Referring first to FIG. 6, a conventional vacuum cleaner will be described. As shown in this figure, the vacuum cleaner 1 comprises a main body 10 in which a motor capable of generating suction power, etc. are installed, a connecting hose 14 which is detachably connected to a main body of the vacuum cleaner, an extension tube 11 of which an upper end is formed with a handle 13, and a suction portion 12 installed at a lower end of the extension tube 11.

The connecting hose 14 is detachably connected to the main body through a fitting member 15 which is installed at an end of the connecting hose 14. The suction portion 12 installed at the lower end of the extension tube 11 is a portion that sucks air containing foreign substances while contacting a plane such as a floor with a gap therebetween and moving thereon. The suction portion 12 is configured to be detachably attached to the extension tube 11.

However, since the suction portion 12 is configured to suitably suck the air from the flat floor, it cannot be properly used, for example, in a corner region, for upholstery, or the like. Thus, in addition to the suction portion 12, accessory tools are provided together with the vacuum cleaner. Such accessory tools can be mainly divided into a crevice tool, a dusting brush, and an upholstery nozzle or tool. The accessory tools are used for desired places in a state where each of them is installed at the lower end of the extension tube 11 after separating the suction portion 12 therefrom.

Since the accessory tools are provided separately from the vacuum cleaner, it is common for a user to store the accessory tools separately from the vacuum cleaner. In such a case where the accessory tools are separately stored, there is inconvenience in that in order to use the desired accessory tool, the user should seek it at a separate storage place and install it again.

SUMMARY OF THE INVENTION

If accessory tools for a vacuum cleaner can be stored together with a main body of the vacuum cleaner, it is possible to completely solve the problem of storing and using the accessory tools. That is, it will be apparent that if the accessory tools are configured to be detachably mounted on the main body of the vacuum cleaner, the problem of storing the accessory tools and the like can be solved. However, it will also apparent that even when the accessory tools are configured to be detachably mounted on the main body of the vacuum cleaner, convenience of use and simplicity of mounting should be first considered.

A primary object of the present invention is to make the storage and use of the accessory tools convenient by allowing the accessory tools provided together with the vacuum cleaner to be easily mounted on the main body of the vacuum cleaner.

According to the present invention for achieving the object, there is provided an accessory tool mounting device for use in a vacuum cleaner including a suction means installed therein, a plurality of wheels installed at an end of the bottom thereof, and exhaust portions for filtering out foreign substances contained in air drawn by the suction means and exhausting the filtered air. The accessory tool mounting device of the present invention comprises wheel fender portions extending outwardly from a main body of the vacuum cleaner for covering upper portions of the wheels; exhaust-portion forming extensions for forming upper parts of the exhaust portions, which extend outwardly from the main body and are formed adjacent to the wheel fender portions; a fastening box member of which an upper end is open and which is formed between the wheel fender portion and the exhaust-portion forming extension and includes a catch protrusion formed to extend inwardly from an inner surface on a side at an upper end thereof; and an accessory mounting member which is insertable downwardly into the fastening box member and includes a U-shaped elastic fastening end having a fastening boss to be caught at the bottom of the catch protrusion and on which a plurality of accessory tools are mounted.

According to an embodiment of the present invention, both sides of the fastening end are further formed with a plurality of supporting bosses which elastically come into contact with inner surfaces of the fastening box member in a fore and aft direction of the vacuum cleaner.

According to another embodiment of the present invention, one of the supporting bosses is formed on the same side as and below the fastening boss of the fastening end, and the supporting boss and the fastening boss are formed to have a length corresponding to a width of the fastening box member in a transverse direction of the vacuum cleaner, thereby preventing the fastening end from playing in the transverse direction.

According to a further embodiment of the present invention, the fastening boss of the fastening end has a length in the transverse direction which corresponds to the width of the fastening box member in the transverse direction so that the fastening boss is in close contact with the inner surface of the fastening box member.

BRIEF DESCRIPTION OF THE DRAWINGS

The above and other objects and features of the present invention will become apparent from the following description of preferred embodiments given in conjunction with the accompanying drawings, in which:

FIG. 2 is a side view of the vacuum cleaner according to the present invention;

FIG. 2A is an enlarged view of portion A of the vacuum cleaner of FIG. 2;

DETAILED DESCRIPTION OF THE PREFERRED EMBODIMENTS

Hereinafter, the present invention will be described in detail with reference to preferred embodiments shown in the accompanying drawings.

Figure 1:
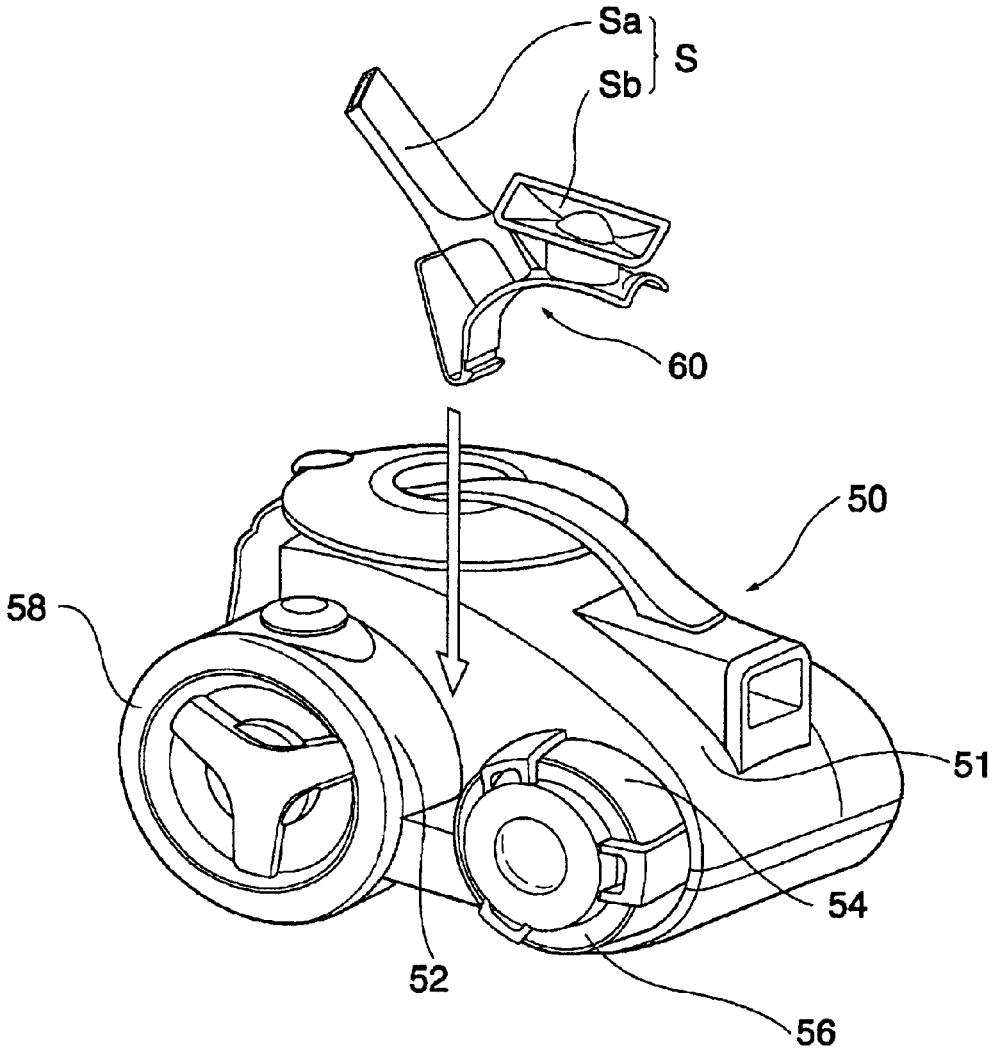
FIG. 1 is a perspective view of a vacuum cleaner according to the present invention.

FIG. 1 is a perspective view of a main body 50 of a vacuum cleaner on which an accessory tool mounting member 60 of the present invention is mounted. FIG. 2 is a side view of the main body of the vacuum cleaner. FIG. 2A is an enlarged view of portion A of the vacuum cleaner of FIG. 2.

The main body 50 of the vacuum cleaner accommodates a suction motor for causing air containing foreign substances to be drawn. The foreign substances contained in the air which is drawn into the main body 50 by the suction motor are filtered out by means of a filtering device within the main body. Then, the filtered and clean air is exhausted to the exterior through exhaust portions 56 formed at lateral surfaces of the main body 50. Further, a pair of wheels 58 are mounted on the bottom of a rear region of the main body 50 so that the main body can be smoothly moved on a floor.

An outer casing 51 of the main body 50 is formed integrally with wheel fender portions 52 for covering upper portions of the wheels 58. Further, the outer casing 51 of the main body 50 is formed integrally with exhaust-portion forming extensions 54 for forming upper parts of exhaust portions 56.

The wheel fender portions 52 and the exhaust-portion forming extensions 54 integrally formed at lateral surfaces of the outer casing 51 of the main body 50 are formed to protrude outwardly from the outer casing such that they are formed to protrude from the lateral surfaces of the outer casing 51 at an angle of about 90° with respect to the lateral surfaces of the outer casing 51.

According to the present invention, an accessory tool mounting member 60 capable of detachably mounting accessory tools S, including a crevice tool Sa for sucking foreign substances in a narrow space, an upholstery tool Sb and the like, thereon is configured to be fitted between the wheel fender portion 52 and the exhaust-portion forming extension 54. It will be apparent that the accessory tools S detachably mounted on the accessory tool mounting member 60 may include the other accessory tools such as a dusting brush in addition to the accessory tools shown in the figure.

Figure 3:
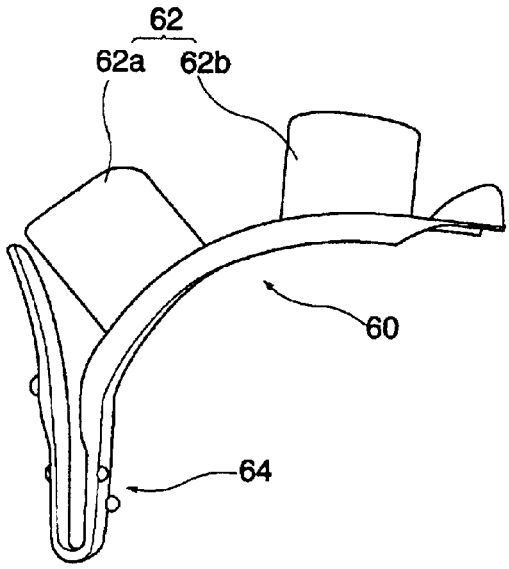
FIG. 3 is a side view of an accessory tool mounting member for use in the vacuum cleaner according to the present invention.

As shown in the side view of FIG. 2A, the space between the wheel fender portion 52 and the exhaust-portion forming extension 54 which take the shape of a partial segment of a circle is generally V-shaped. As can be seen from FIG. 3, the accessory tool mounting member 60 according to the present invention is also V-shaped.

Tubular mounting portions 62*a*, 62*b* into which the accessory tools S are fitted and secured are formed at a top surface on a side of the accessory tool mounting member 60. Therefore, the accessory tools S can be fitted into the mounting portions 62. A lower end of the accessory tool mounting member 60 is formed into a U-shaped fastening end 64. The fastening end 64 is a portion capable of being detachably coupled with a fastening box member 70 to be described later.

Both side surfaces of the fastening end 64 of the accessory tool mounting member 60 are formed with a fastening boss 64*a* and a plurality of supporting bosses 64*b*, 64*c*. The accessory tool mounting member 60 formed by injection-molding synthetic resin materials has certain elasticity at the fastening end 64.

The fastening box member 70 with which the fastening end 64 is detachably coupled is fixed between the wheel fender portion 52 and the exhaust-portion forming extension 54. It is preferred that the outer casing 51 of the main body be formed integrally with the fastening box member 70.

The fastening box member 70 takes the shape of a box of which at least an upper end is open. In the illustrated embodiment, the fastening box member 70 takes the shape of a cylinder with open upper and lower ends. As shown in a detailed view of FIG. 2, the open upper end of the fastening box member is formed with an inwardly protruding catch protrusion 72.

The fastening end 64 can be inserted into and fastened to the fastening box member 70. That is, when the fastening boss 64*a* formed at a side surface of the fastening end 64 is caught at the bottom of the catch protrusion 72, the accessory tool mounting member 60 becomes in a state where it is securely seated in the fastening box member 70. In this state, the supporting bosses 64*b*, 64*c* of the fastening end 64 come into contact with respective inner surfaces of the fastening box member 70 and thus it is possible to maintain the state where the mounting member 60 is fastened to the interior of the fastening box member 70.

Figure 4:
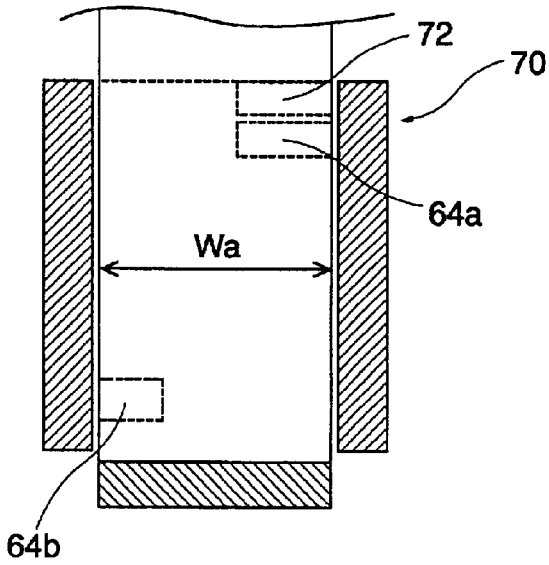
FIG. 4 is a sectional view taken along line IV—IV of FIG. 2A.

As shown in FIG. 4 that is a sectional view taken along line IV—IV of FIG. 2A, the catch protrusion 72 formed to protrude inwardly at the upper end of the fastening box member 70 and the fastening boss 6*a* caught at the bottom of the catch protrusion are formed on the right-hand side, whereas the lower supporting boss 64*b* is formed on the left-hand side.

An interval between the fastening boss 64*a* and the supporting boss 64*b* substantially corresponds to a width Wa of the fastening box member 70 in a transverse direction of the main body. Thus, when the mounting member 60 is inserted into and fastened to the fastening box member 70,the fastening boss 64*a* and the supporting boss 64*b* are tightly fitted into the fastening box member 70. Accordingly, it is possible to prevent unnecessary play of the mounting member in the transverse direction.

However, the present invention is not limited to the embodiment. It will be apparent that various modifications can be made to the coupling relationship between the fastening end 64 and the fastening box member 70. That is, it will be apparent that the U-shaped fastening end 64 formed at the lower end of the accessory tool mounting member 60 can be variously modified within the technical scope of the detachable coupling of the mounting member with the fastening box member 70.

Figure 5:
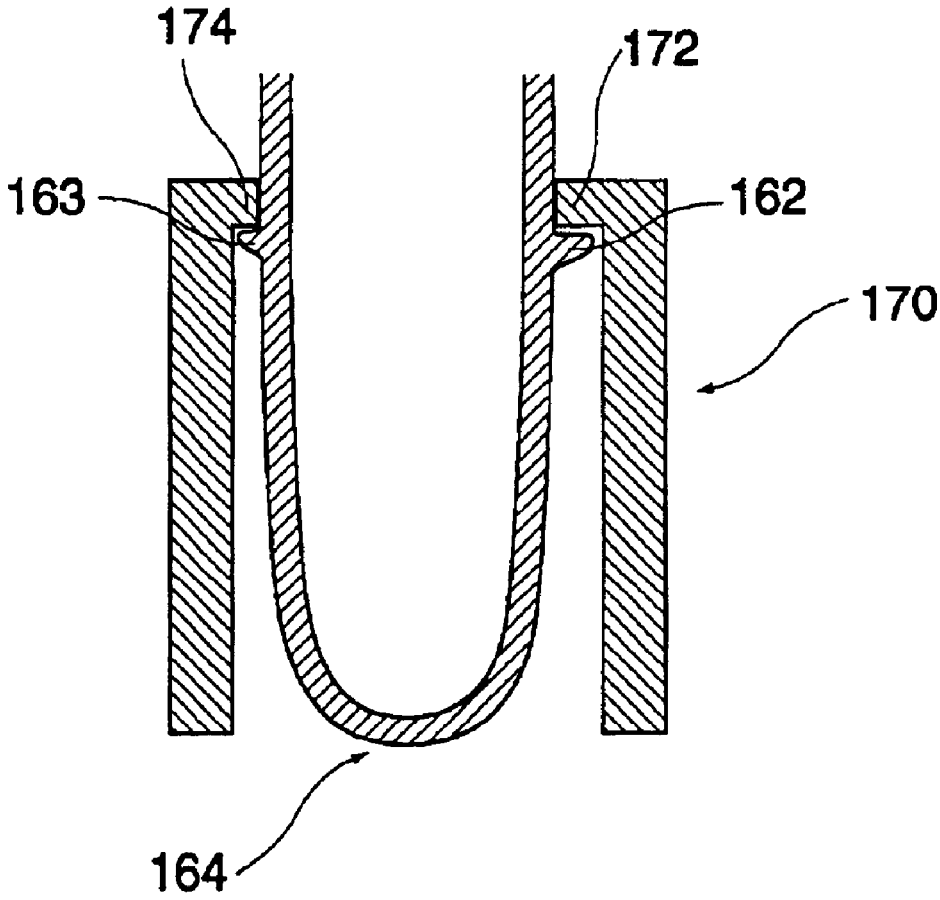
FIG. 5 is a sectional view of an essential portion of another embodiment of the present invention.
Figure 6:
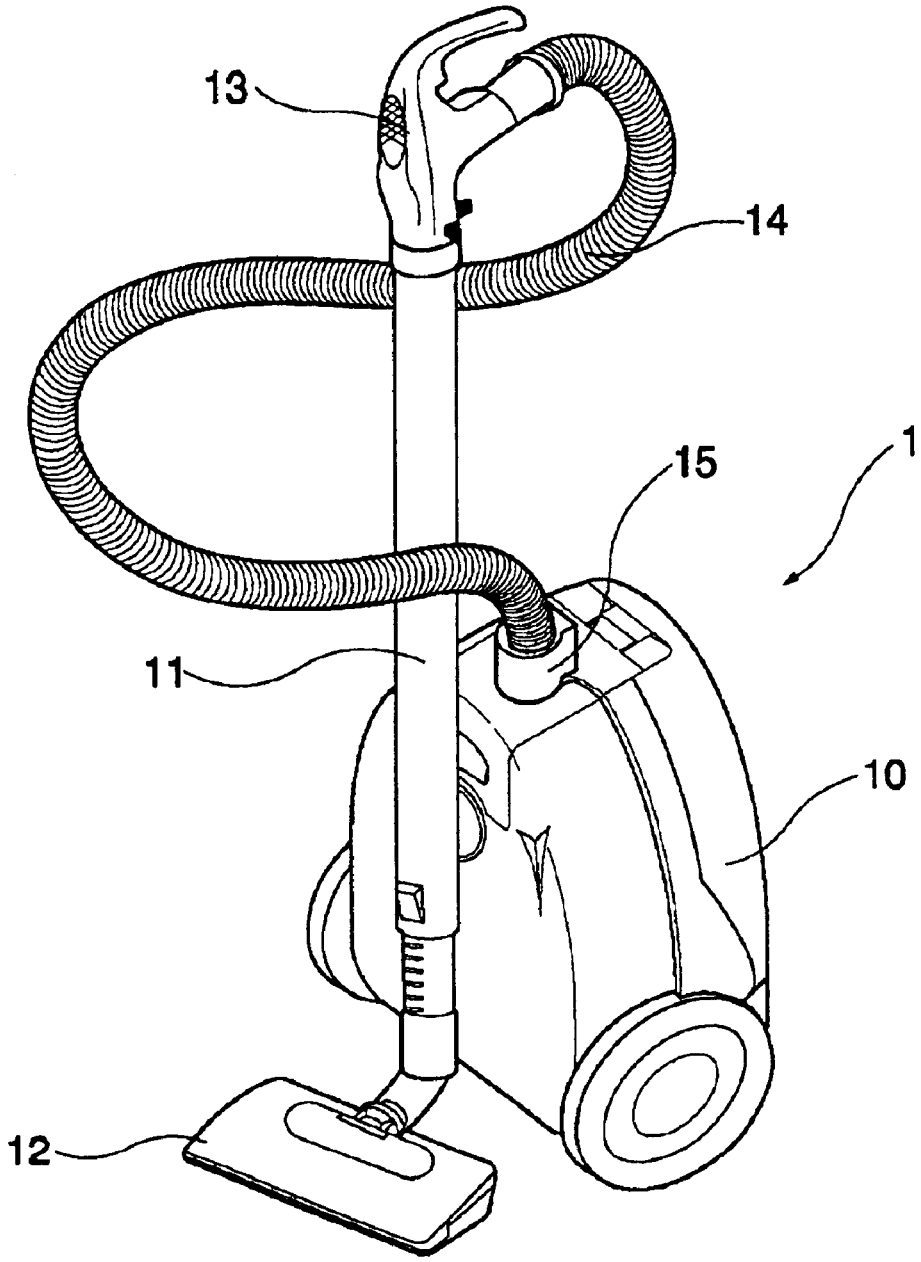
FIG. 6 is a perspective view of a conventional vacuum cleaner.

As illustrated in FIG. 5 showing another embodiment of the fastening end of the accessory tool mounting member and the fastening box member, a pair of catch protrusions 172, 174 can be formed at both inner sides of an upper end of a fastening box member 170, and both sides of a fastening end 164 can be formed with fastening bosses 162, 163 to be caught at the bottom of the catch protrusions 172, 174, respectively. Even in such a constitution, the fastening end 164 is elastically deformed inwardly so that the fastening end 164 can be detachably coupled with the fastening box member 170 in an elastic manner.

Further, in the embodiments shown in FIGS. 4 and 5, it will be apparent that the catch protrusion 72 or 172 and the fastening boss 64*a* or 162 are formed to have a full length corresponding to the width of the fastening box member 70 or 170 in the transverse direction so as to prevent any play from being produced in the transverse direction.

Moreover, even in the embodiment shown in FIG. 5, it will also be apparent that a plurality of supporting bosses such as the bosses 64*b*, 64*c* may be formed as shown in FIG. 4.

According to the present invention described above, it can be understood that the accessory tool mounting member 60 is detachably installed between the wheel fender portion 52 and the exhaust-portion forming extension 54 which are integrally formed with the outer casing 51 of the main body 50 of the vacuum cleaner. The accessory tools S are configured to be detachably mounted on the accessory tool mounting member 60.

Therefore, it can be understood that the plurality of accessory tools S are detachably mounted on the mounting member 60 and thus detachably coupled substantially to a side of the main body 50 of the vacuum cleaner.

Considering the state where the mounting member 60 with the accessory tools S mounted thereon is coupled with the main body 50, it can be understood that there are no portions protruding from the main body 50 of the vacuum cleaner in the transverse direction thereof. Therefore, even when the mounting member 60 of the present invention is substantially coupled to the main body 50, there are no portions protruding outwardly from both sides of the main body 50 despite of the installation of the mounting member 60. Accordingly, there is no inconvenience of storage and movement of the vacuum cleaner.

Since the plurality of accessory tools S are mounted on the main body 50 of the vacuum cleaner by using the mounting member 60 according to the present invention, it is possible to conveniently use the accessory tools at any time, if necessary.

According to the present invention described above, the plurality of accessory tools are in a state where they are mounted on the main body 50 of the vacuum cleaner. Thus, it is expected to obtain convenience in that a proper accessory tool can be installed in the vacuum cleaner so as to be used for cleaning at any time, if necessary.

Further, since the accessory tools are not separately stored, it is apparent that the inconvenience of separate storage of the accessory tools can be solved.

Accordingly, there is an advantage in that the vacuum cleaner can be more conveniently used.

It will be apparent that those skilled in the art can make various modifications within the scope of the technical sprit of the invention. Further, the present invention should be construed based on the appended claims.

What is claimed is:

1. An accessory tool mounting device for use in a vacuum cleaner including a suction means installed therein, a plurality of wheels installed at an end of the bottom thereof, and exhaust portions for filtering out foreign substances contained in air drawn by the suction means and exhausting the filtered air, comprising:

wheel fender portions extending outwardly from a main body of the vacuum cleaner for covering upper portions of the wheels;

exhaust-portion forming extensions for forming upper parts of the exhaust portions, said exhaust-portion forming extensions extending outwardly from the main body and being formed adjacent to the wheel fender portions;

a fastening box member of which an upper end is open and which is formed between the wheel fender portion and the exhaust-portion forming extension and includes a catch protrusion formed to extend inwardly from an inner surface on a side at an upper end thereof; and an accessory mounting member which is insertable downwardly into the fastening box member and includes a U-shaped elastic fastening end having a fastening boss to be caught at the bottom of the catch protrusion and on which a plurality of accessory tools are mounted.

2. The accessory tool mounting device as claimed in claim 1, wherein both sides of the fastening end are further formed with a plurality of supporting bosses which elastically come into contact with inner surfaces of the fastening box member in a fore and aft direction of the vacuum cleaner.

3. The accessory tool mounting device as claimed in claim 2, wherein the supporting boss is formed on the same side as and below the fastening boss, and the supporting boss and the fastening boss are formed to have a length corresponding to a width Wa of the fastening box member in a transverse direction of the vacuum cleaner, thereby preventing the fastening end from playing in the transverse direction.

4. The accessory tool mounting device as claimed in claim 1, wherein the fastening boss has a length in a transverse direction of the vacuum cleaner which corresponds to a width Wa of the fastening box member in the transverse direction so that the fastening boss is in close contact with the inner surface of the fastening box member.

* * * * *